US009095202B1

(12) United States Patent
Vanheteren

(10) Patent No.: US 9,095,202 B1
(45) Date of Patent: Aug. 4, 2015

(54) CONCEALED KNIFE SYSTEM

(71) Applicant: William J Vanheteren, Hope, NJ (US)

(72) Inventor: William J Vanheteren, Hope, NJ (US)

( * ) Notice: Subject to any disclaimer, the term of this patent is extended or adjusted under 35 U.S.C. 154(b) by 0 days.

(21) Appl. No.: 14/500,607

(22) Filed: Sep. 29, 2014

Related U.S. Application Data

(60) Provisional application No. 61/965,459, filed on Jan. 30, 2014.

(51) Int. Cl.

| | |
|---|---|
| ***B26B 29/02*** | (2006.01) |
| ***A45F 5/00*** | (2006.01) |
| ***A45F 5/02*** | (2006.01) |
| *A44B 11/00* | (2006.01) |

(52) U.S. Cl.
CPC ..... *A45F 5/021* (2013.01); *B26B 29/02* (2013.01); *A44B 11/005* (2013.01); *A45F 2200/0591* (2013.01); *B26B 29/025* (2013.01)

(58) Field of Classification Search
CPC ..... A44B 11/005; B26B 29/025; A45F 2200/0591
USPC ..... 224/587, 232
See application file for complete search history.

(56) References Cited

U.S. PATENT DOCUMENTS

| | | | | |
|---|---|---|---|---|
| 3,823,422 | A | 7/1974 | Forgett, Jr. | |
| 4,078,272 | A * | 3/1978 | Mahon, III | 24/186 |
| 4,096,979 | A * | 6/1978 | Collins | 224/163 |
| 4,100,655 | A * | 7/1978 | Langley | 24/163 K |
| 4,203,167 | A * | 5/1980 | Collins | 2/322 |
| 4,313,230 | A * | 2/1982 | Chovaniec | 2/322 |
| 4,389,775 | A | 6/1983 | Collins | |
| 4,466,561 | A * | 8/1984 | Slaughter | 224/163 |
| 4,481,712 | A * | 11/1984 | Phelps | 30/151 |
| 4,494,310 | A | 1/1985 | Slaughter | |
| 4,561,577 | A | 12/1985 | Moore | |
| 4,753,377 | A * | 6/1988 | Poluhowich | 224/163 |
| 5,217,150 | A * | 6/1993 | Chen | 224/163 |
| 5,915,793 | A * | 6/1999 | Serpa | 30/162 |
| 6,067,661 | A * | 5/2000 | Bates | 2/338 |
| 6,185,772 | B1 * | 2/2001 | Bates | 7/151 |
| 8,056,780 | B1 * | 11/2011 | Bruns | 224/163 |

* cited by examiner

*Primary Examiner* — Justin Larson
(74) *Attorney, Agent, or Firm* — Thomas J. Germinario

(57) ABSTRACT

A method of concealing a fixed blade knife inconspicuously behind a trouser belt utilizes a rotating sheath connected by a strap to the tongue of the belt buckle. The sheath is concealed behind the belt by pushing it upward into alignment with the strap and is deployed by pushing it downward out of alignment with the strap. The knife is curved so as to conform to the contours of the wearer's waist.

2 Claims, 4 Drawing Sheets

CONCEALED KNIFE SYSTEM

REFERENCE TO RELATED APPLICATION

This Application claims the benefit of the filing date of Provisional Patent Application No. 61/965,459, filed on Jan. 30, 2014.

FIELD OF INVENTION

The present invention relates to the field of knife sheaths, and more particularly to concealable knife sheaths.

BACKGROUND OF THE INVENTION

Small knives may be carried on the person for purposes of self-defense or by military and law enforcement personnel. It is often desirable to conceal such knives, lest an assailant noticing its location attempt to seize it. One of the common methods of concealing a knife is to incorporate it into a belt buckle, but this often results in a buckle which is large and conspicuous, thus giving away the presence of a concealed weapon.

Along with inconspicuous concealment, there is also a need to conceal the knife so that it is readily and quickly deployable. The present invention provides a method of unobtrusively concealing a knife behind a standard trouser belt in a manner that enables the knife to be quickly accessed in an emergency situation.

SUMMARY OF THE INVENTION

As used in the Specification and Claims hereof, the following definitions apply:

Directions "above" and "below", and "upward" and "downward", are defined relative to the location of a trouser belt worn about the waist of an individual, so that the terms "above" and "upward" refer to the direction of the upper torso of the wearer, while the terms "below" and "downward" refer to the direction of the lower torso of the wearer.

The position "behind" is defined relative to the location of a trouser belt worn about the waist of an individual, such that "behind" the belt means in the intervening space between the belt and the waist of the wearer.

A "fixed blade knife" is defined as a knife in which the blade and the handle are made in one piece.

The "circumference" of a belt is defined as the belt size in inches, so that a "size 36" belt is considered to have a circumference of 36 inches.

The method of the present invention can be used with a standard trouser belt having a buckle with a frame and a tongue. A fixed blade knife is provided with a radius of curvature corresponding to the circumference of the belt, based on the belt size. Various curvatures can be available to accommodate a range of belt sizes. For example, the following knife curvatures could be provided:

| | Belt Size C | Blade Curvature R |
|---|---|---|
| XL | 40" | 12.7" |
| L | 36" | 11.5" |
| M | 32" | 10.2" |
| S | 28" | 8.9" |

Where the knife radius of curvature R is calculated as $C/2\pi$. The curvature of the knife thus conforms to contours of the wearer's waistline, so that the knife does not create any discernable projections or bulges when worn against the waist.

A sheath encloses the knife blade, with the knife handle projecting from the open end of the sheath. Rotatably attached by a swivel joint near the open end of the sheath is an oblong retaining strap, which has a hole near its distal end, that is, opposite to the end attached to the sheath.

When the belt buckle is opened, the retaining strap is rotated into a position in which the buckle tongue can be inserted through the strap's hole. The belt buckle is then closed, thereby securing the strap and sheath to the buckle. The sheath is then rotated into alignment with the retaining strap and pushed upward so as to tuck it behind the belt, thereby concealing the knife from view. In order to secure the knife in this concealed location, one or more cooperating hook-and-loop fasteners are provided on the sheath and strap, so that engaging the fasteners holds the sheath and knife in place.

When the knife needs to be deployed, the wearer simply inserts his/her fingers behind the belt and pushes downward on the sheath, so that it rotates about the swivel joint into an oblique or perpendicular orientation with respect to the retaining strap and emerges from behind the belt, such that the handle of the knife can be grasped and the knife can be quickly pulled out of the sheath.

The foregoing summarizes the general design features of the present invention. In the following sections, specific embodiments of the present invention will be described in some detail. These specific embodiments are intended to demonstrate the feasibility of implementing the present invention in accordance with the general design features discussed above. Therefore, the detailed descriptions of these embodiments are offered for illustrative and exemplary purposes only, and they are not intended to limit the scope either of the foregoing summary description or of the claims which follow.

DETAILED DESCRIPTION OF THE PREFERRED EMBODIMENT

Figure 1A:
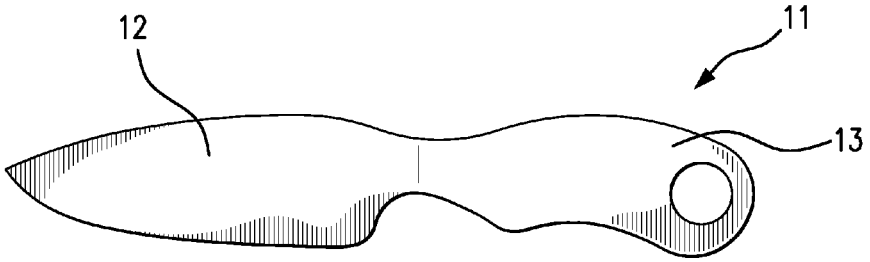
FIG. 1A is a side profile view of a fixed blade knife according to one embodiment of the present invention.
Figure 1B:
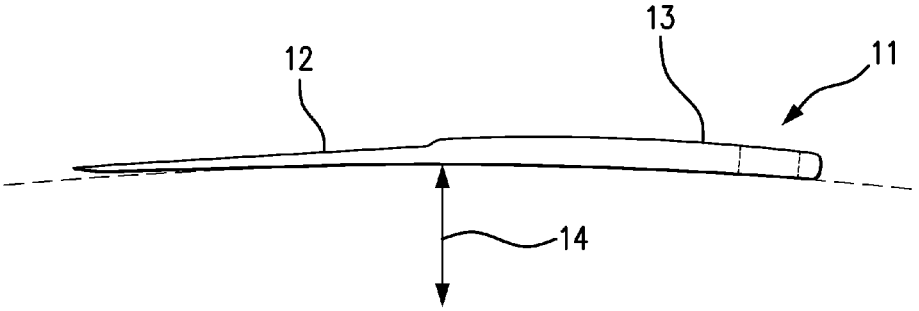
FIG. 1B is a top plan view of the knife depicted in FIG. 1A.
Figure 2A:
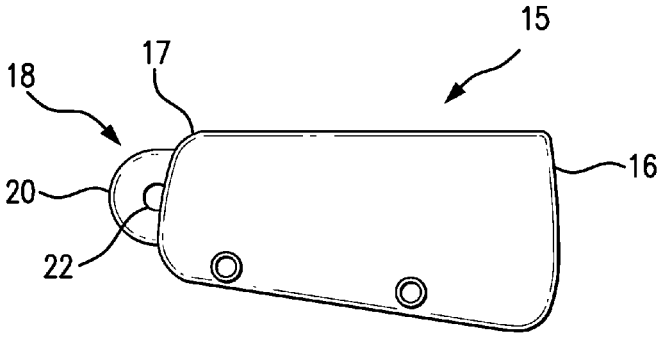
FIG. 2A is a first side profile view of a sheath with an attached retaining strap according to one embodiment of the present invention.
Figure 2B:
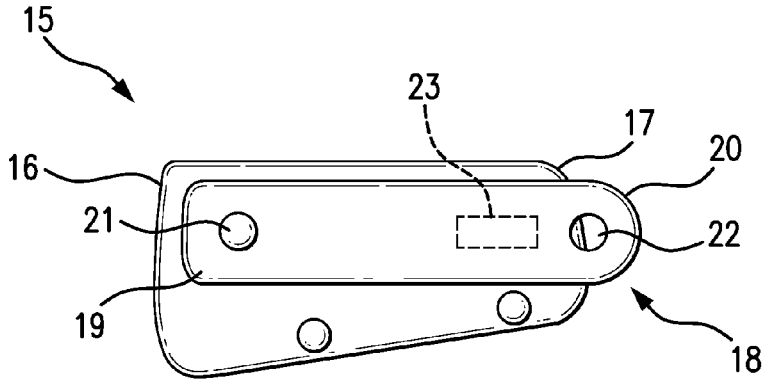
FIG. 2B is a second side profile view of a sheath with an attached retaining strap according to one embodiment of the present invention.
Figure 2C:
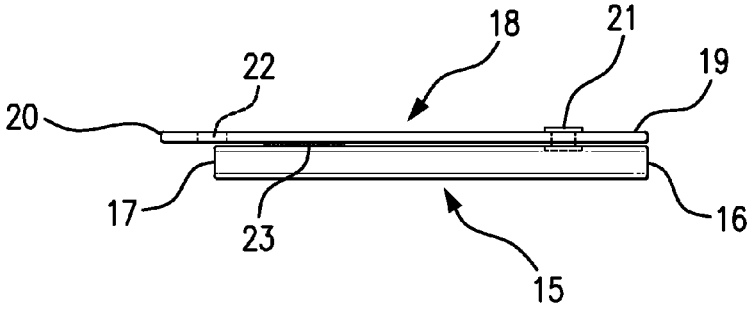
FIG. 2C is a top plan view of a sheath with an attached retaining strap according to one embodiment of the present invention.
Figure 2D:
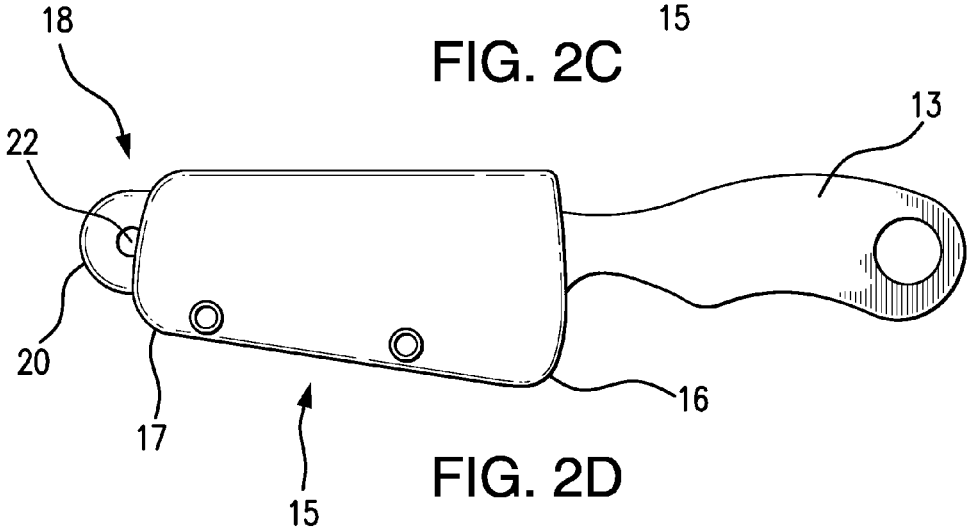
FIG. 2D is a side profile view of the knife of FIGS. 1A and 1B enclosed in the sheath depicted in FIGS. 2A-2C.
Figure 3A:
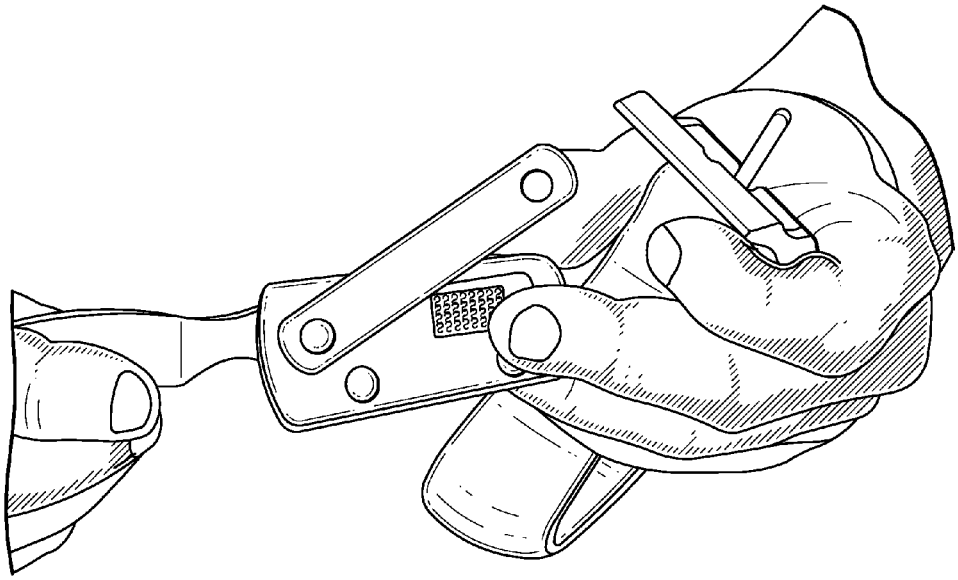
FIG. 3A depicts the operations of opening the belt buckle and rotating the retaining strap into position for insertion of the buckle tongue into the hole of the strap.
Figure 3B:
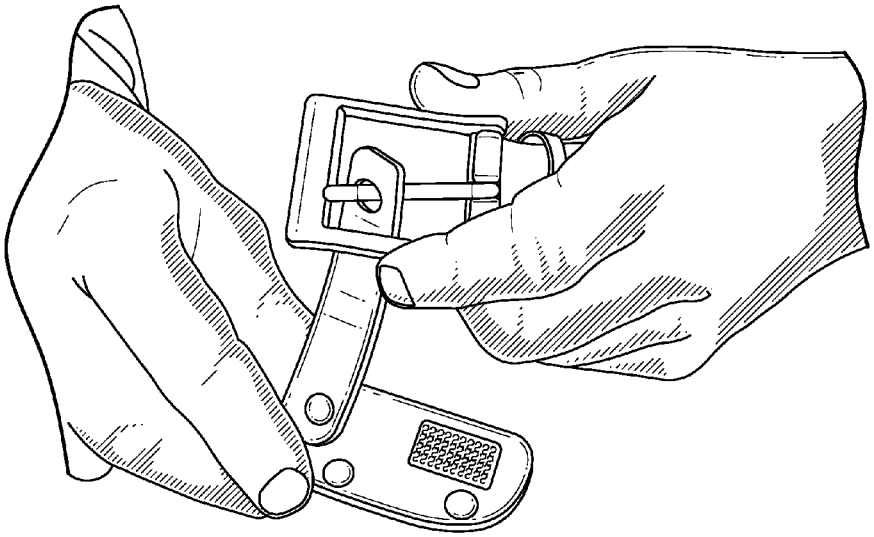
FIG. 3B depicts the operation of inserting the buckle tongue into the hole of the retaining strap.
Figure 3C:
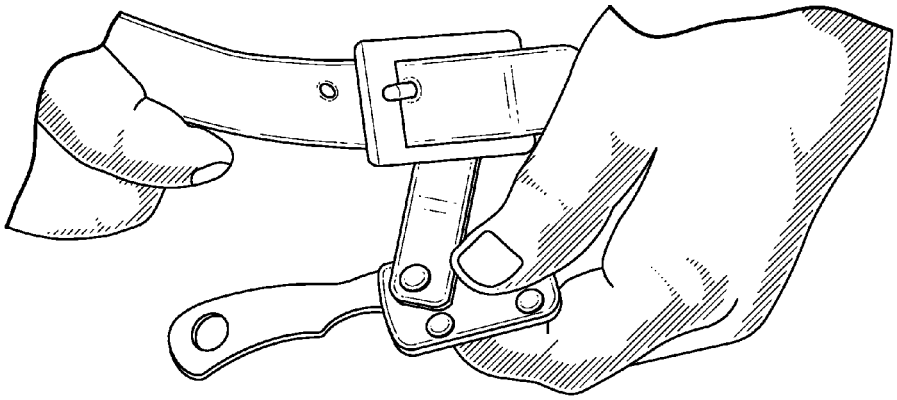
FIG. 3C depicts the operations of pushing upward on the sheath and rotating it into alignment with the sheath.
Figure 3D:
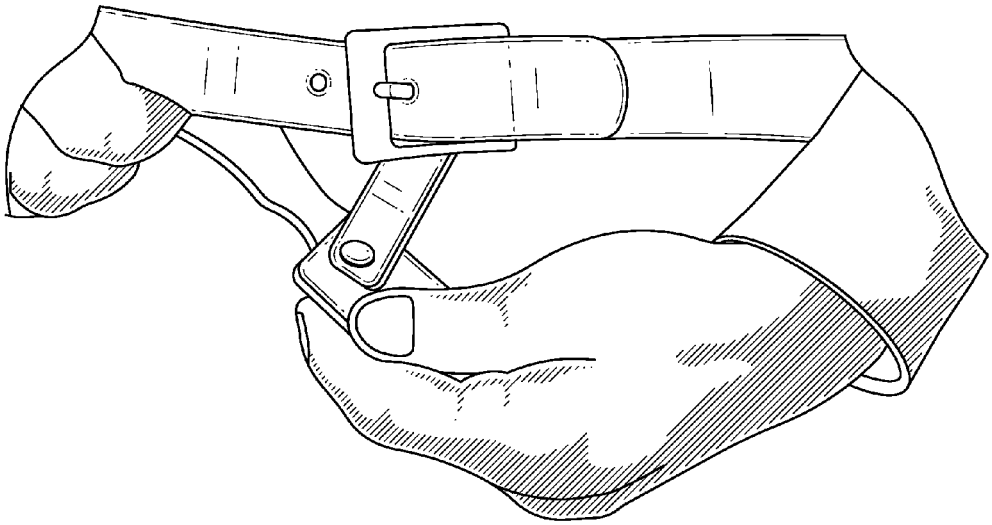
FIG. 3D depicts the operation of tucking the sheath, with the knife enclosed, behind the belt so as to conceal them.

Referring to FIGS. 1A and 1B, the fixed blade knife 11 comprises a blade 12 and handle 13 manufactured as an integral unit. The knife 11 has a radius of curvature 14 corresponding to the circumference of the belt, so as to conform to the waist contours of the wearer for optimum concealment.

FIGS. 2A-2D depict the sheath 15, which has an open end 16 and a closed end 17. A retaining strap 18 is attached at its proximal end 19 to the open end 16 of the sheath 15 by means of a swivel joint 21, about which the strap 18 and sheath 15 can mutually rotate with respect to one another. The distal end 20 of the retaining strap 18 has an aperture 22 sized to slide over the buckle tongue. Cooperating hook-and-loop fasteners 23 on the sheath 15 and retaining strap 18 secure them in alignment so that the knife 11 does not drop from behind the belt.

FIGS. 3A-3D depict the process by which the belt buckle is opened, the retaining strap 18 is rotated into position, and the buckle tongue is inserted into the strap's aperture 22. The buckle is then closed and the sheath 15, with the knife 11 enclosed, is pushed upward into alignment with the strap 18 and tucked behind the belt so as to conceal it there. Reversing the process, going from FIG. 3D to FIG. 3C, the knife 11 can be deployed for use by pushing downward on the sheath 15, so that it rotates to an oblique or perpendicular orientation relative to the strap 18, thereby causing the knife 11 to emerge from behind the belt with its handle 13 accessible to the grasp of the wearer.

Although the preferred embodiment of the present invention has been disclosed for illustrative purposes, those skilled in the art will appreciate that many additions, modifications and substitutions are possible, without departing from the scope and spirit of the present invention as defined by the accompanying claims.

What is claimed is:

1. A method for deployably concealing a fixed blade knife behind a trouser belt having a circumference, comprising the following steps:

(a) providing the belt with a belt buckle having a buckle frame and a buckle tongue;

(b) providing the knife with a blade portion and a handle portion and with a radius of curvature corresponding to the circumference of the belt;

(c) providing a sheath in which the blade portion of the knife is removably enclosed, wherein the sheath has an open end and a closed end;

(d) providing an oblong retaining strap, which has a proximal end and a distal end, wherein the proximal end is rotatably attached by a swivel joint to the open end of the sheath, and the distal end has a strap aperture;

(e) opening the belt buckle and inserting the buckle tongue through the strap aperture, then closing the belt buckle;

(f) aligning the retaining strap with the sheath and pushing upward on the sheath, so as to tuck it behind the belt, such that the knife is concealed behind the belt; and (g) deploying the knife by pushing downward on the sheath, so that the sheath rotates about the swivel joint out of alignment with the retaining strap and emerges from behind the belt, such that the handle portion of a knife is accessible below the belt.

2. The method of claim 1, further comprising an additional step (d2), between steps (d) and (e), and an additional step (f2), between steps (f) and (g), as follows:

(d2) providing the sheath and the retaining strap with one or more cooperating hook-and-loop fasteners;

(f2) mutually engaging the cooperating hook-and-loop fasteners, so as to releasably secure the sheath in alignment with the retaining strap, such that the knife remains concealed behind the belt until the knife is deployed.

* * * * *